US005743773A

United States Patent [19]

Saito et al.

[11] Patent Number: 5,743,773

[45] Date of Patent: Apr. 28, 1998

[54] PROPULSION SYSTEM FOR WATERCRAFT

[75] Inventors: Chitose Saito; Yasunari Okamoto, both of Hamamatsu, Japan

[73] Assignee: Sanshin Kogyo Kabushiki Kaisha, Hamamatsu, Japan

[21] Appl. No.: 790,703

[22] Filed: Jan. 29, 1997

[30] Foreign Application Priority Data

Jan. 29, 1996 [JP] Japan ..... 8-035378

[51] Int. Cl.[6] ..... B63H 5/125

[52] U.S. Cl. ..... 440/53

[58] Field of Search ..... 114/144 R; 440/6, 440/7, 53, 55, 57, 62, 63, 84, 900

[56] References Cited

U.S. PATENT DOCUMENTS 3,983,834 10/1976 Hirmann ..... 440/63

FOREIGN PATENT DOCUMENTS 686412 3/1965 Italy ..... 440/63

57-154605 9/1982 Japan .

*Primary Examiner*—Jesus D. Sotelo

*Attorney, Agent, or Firm*—Knobbe, Martens, Olson & Bear LLP

[57] ABSTRACT

A small, compact electrically operated outboard motor for use with a very small watercraft. A substantial portion of the propulsion device for the outboard motor is intended to be submerged and is mounted for steering and tilt and trim movement. These movements are controlled as well as the speed and direction of rotation by a control lever and mounting arrangement that can be conveniently positioned within the hull of an associated watercraft.

19 Claims, 5 Drawing Sheets

PROPULSION SYSTEM FOR WATERCRAFT

BACKGROUND OF THE INVENTION

This invention relates to a propulsion system for a watercraft and more particularly to an improved compact, small propulsion system and control therefor.

The use of outboard motors as a propulsion system for watercraft is well known. Generally, the outboard motor is mounted in some way on the associated watercraft for steering movement about a vertically extending axis and for tilt and trim movement about a horizontally disposed axis. The outboard motors normally used for this purpose fall into two general categories. The first of these are designed primarily to be relatively permanently attached to the watercraft and thus form a substantial integral portion thereof. The other is more readily detachable from the watercraft and can be used on any of a wide variety of types of watercraft. This invention deals with the latter type of propulsion system.

The outboard motors of the readily detachable type generally have a construction that is substantially the same as the larger more permanently attached outboard motors. That is, they employ a clamping bracket that is affixed to the transom of the watercraft and which has a pivotal connection to a swivel bracket for the tilt and trim movement. The swivel bracket, in turn, supports the main components of the outboard motor via a steering shaft. This steering shaft is journaled in the swivel bracket for steering movement about a generally vertically disposed steering axis.

The propulsion system itself is comprised of a prime mover that is mounted in a power head and which drives a propulsion device such as a propeller that is journaled in a lower unit via a drive shaft that extends through a drive shaft housing. As a result, the construction is quite cumbersome and, even for small motors, quite heavy.

Also, the type of construction described is not particularly adapted for use with certain types of watercraft such as canoes or sailboats. When utilized with such other types of watercraft, a outrigger-type support or other type of supporting bracket must be attached to the watercraft. In addition, these smaller outboard motors are normally controlled by a tiller and such controls do not have particular utility with these other types of watercraft with which outboard motors may be utilized.

It is, therefore, a principal object of this invention to provide an improved small portable-type propulsion system for a watercraft.

It is a further object of this invention to provide a relatively small, compact watercraft propulsion system and attachment method for attachment to an associated watercraft that permits utilization with a wide variety of types of watercraft and particularly those which are quite small.

It is a still further object of this invention to provide an improved control for a compact propulsion system.

SUMMARY OF THE INVENTION

A first feature of this invention is adapted to be embodied in an outboard motor that is comprised of a propulsion system consisting of a prime mover and a propulsion shaft driven by the prime mover and contained within a common housing with it. The propulsion shaft drives a propulsion device that is supported by the common housing but is positioned externally of it. Means are provided for mounting the common housing from a watercraft hull with the common housing being at least substantially submerged in a body of water in which the watercraft hull is floating. This mounting means permits steering movement of the propulsion system about a generally vertically-extending axis for steering of the associated watercraft and for pivotal movement about a generally horizontally-extending axis for adjusting the trim of the propulsion device.

A further feature of the invention is adapted to be embodied in a remote control unit for controlling, for example, the type of propulsion device described in the preceding paragraph. This remote control unit comprises a mounting housing that is adapted to be mounted in a suitable position in the hull of a watercraft. A control lever is mounted on this mounting housing for pivotal movement about two transverse, perpendicular pivotal axes for steering and trim control of an associated propulsion device by pivotal movement about the respective axes.

DETAILED DESCRIPTION OF THE PREFERRED EMBODIMENT OF THE INVENTION

Figure 1:
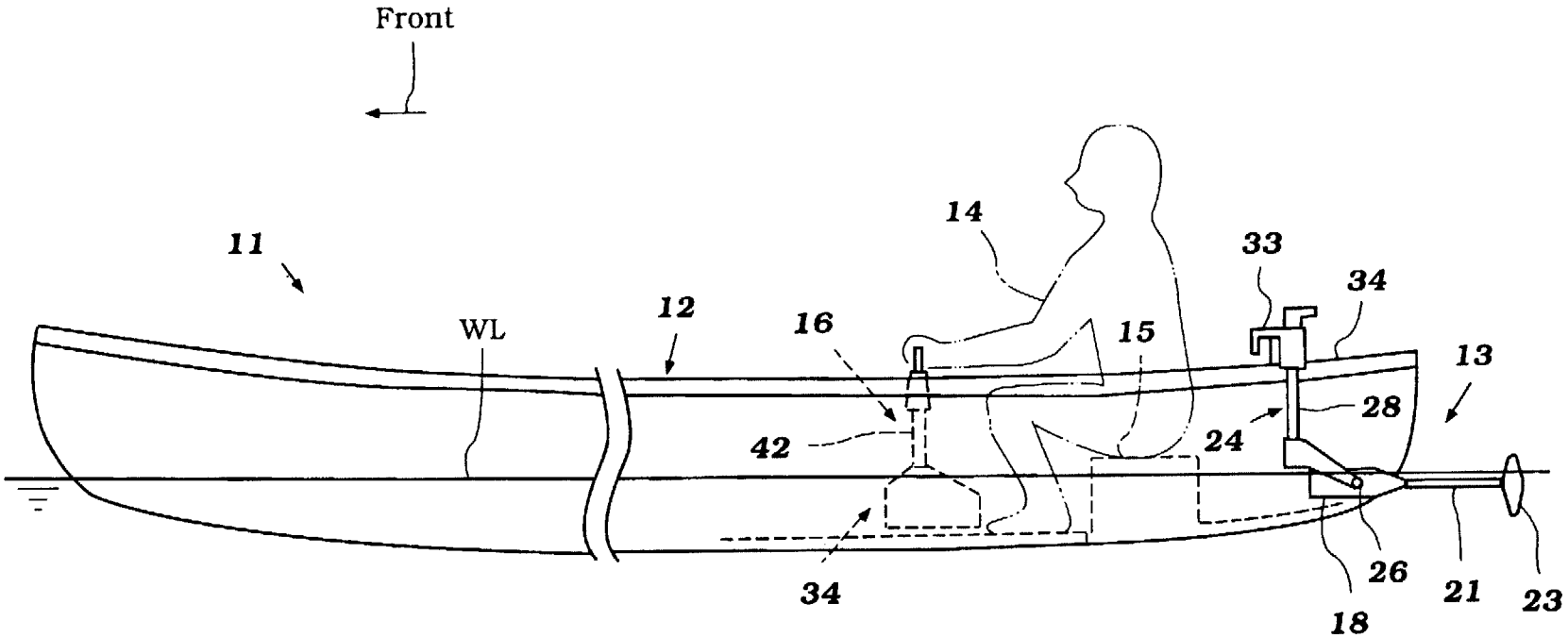
FIG. 1 is a side elevational view of a watercraft powered by a propulsion device constructed in accordance with an embodiment of the invention and controlled by a control unit constructed in accordance with an embodiment of the invention.

Referring now in detail to the drawings and initially to FIG. 1, a watercraft constructed in accordance with an embodiment of the invention is indicated generally by the reference numeral 11. The watercraft 11 includes a hull 12. In the illustrated embodiment, the hull 12 is basically a canoe-type hull. This type of hull is shown because the invention has particular utility in the application for propulsion systems for watercraft of small type and which have a hull that does not necessarily have a transom to which the propulsion device can be attached. It will be readily apparent to those skilled in the art of the various types of watercraft with which the invention may be utilized.

A propulsion device, indicated generally by the reference numeral 13, is mounted at the rear of the hull 12 in a manner which will be described. This is in a position that will be to the rear of an operator, shown in phantom and indicated at 14 seated on a seat 15 within the hull 12. A control unit constructed in accordance with another feature of the invention, indicated generally by the reference numeral 16 can be mounted in the hull 12 forwardly of the seated operator 14.

The water level at which the watercraft 11 normally rides is indicated by the line WL. This line is indicated because it is helpful to the reader's understanding of how the components of the propulsion device 13 relate to the body of water in which the watercraft 11 is operating. This is a significant feature of the invention.

Figure 2:
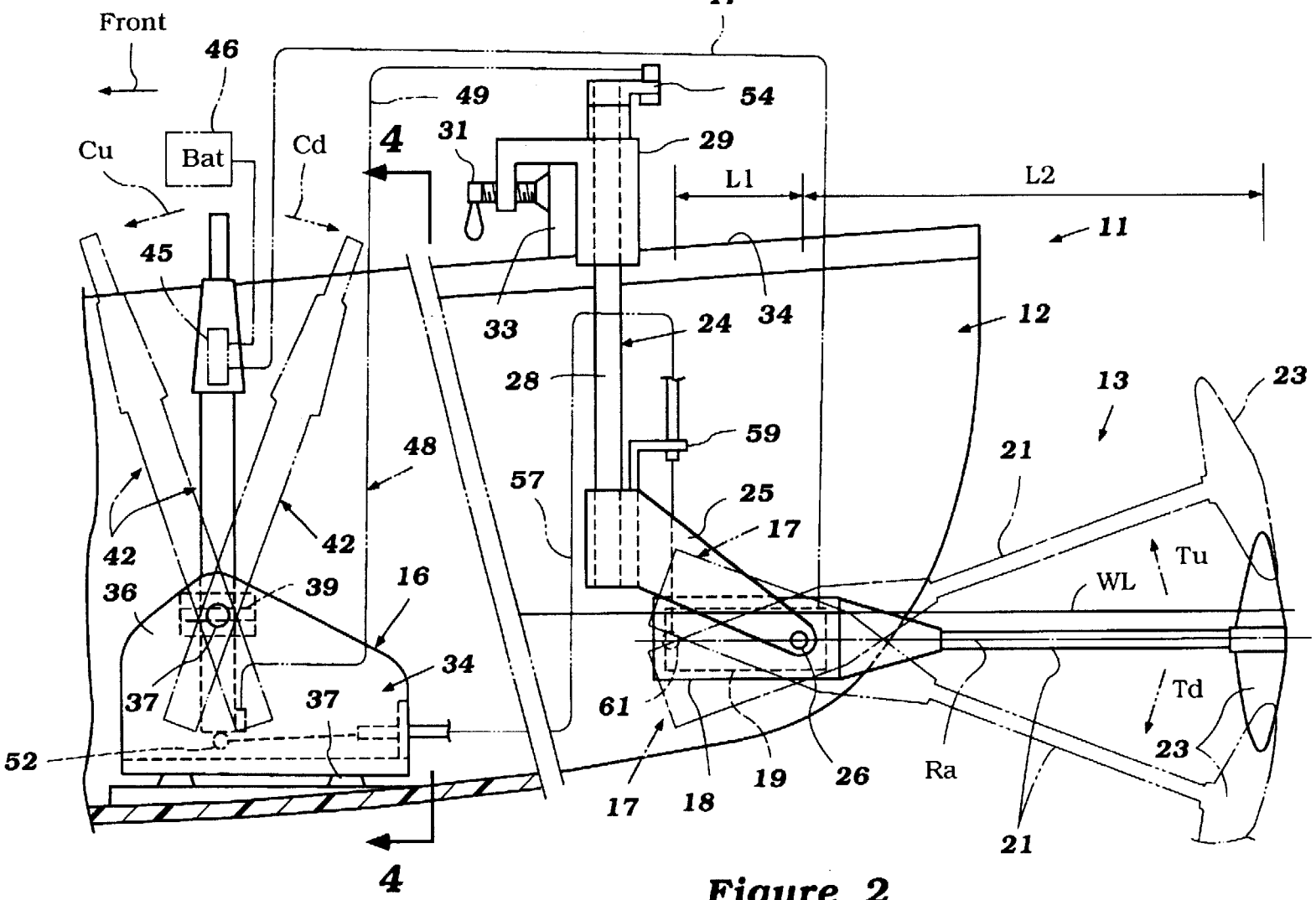
FIG. 2 is an enlarged side elevational view, in part similar to FIG. 1, but shows the control unit and propulsion device in various positions.
Figure 3:
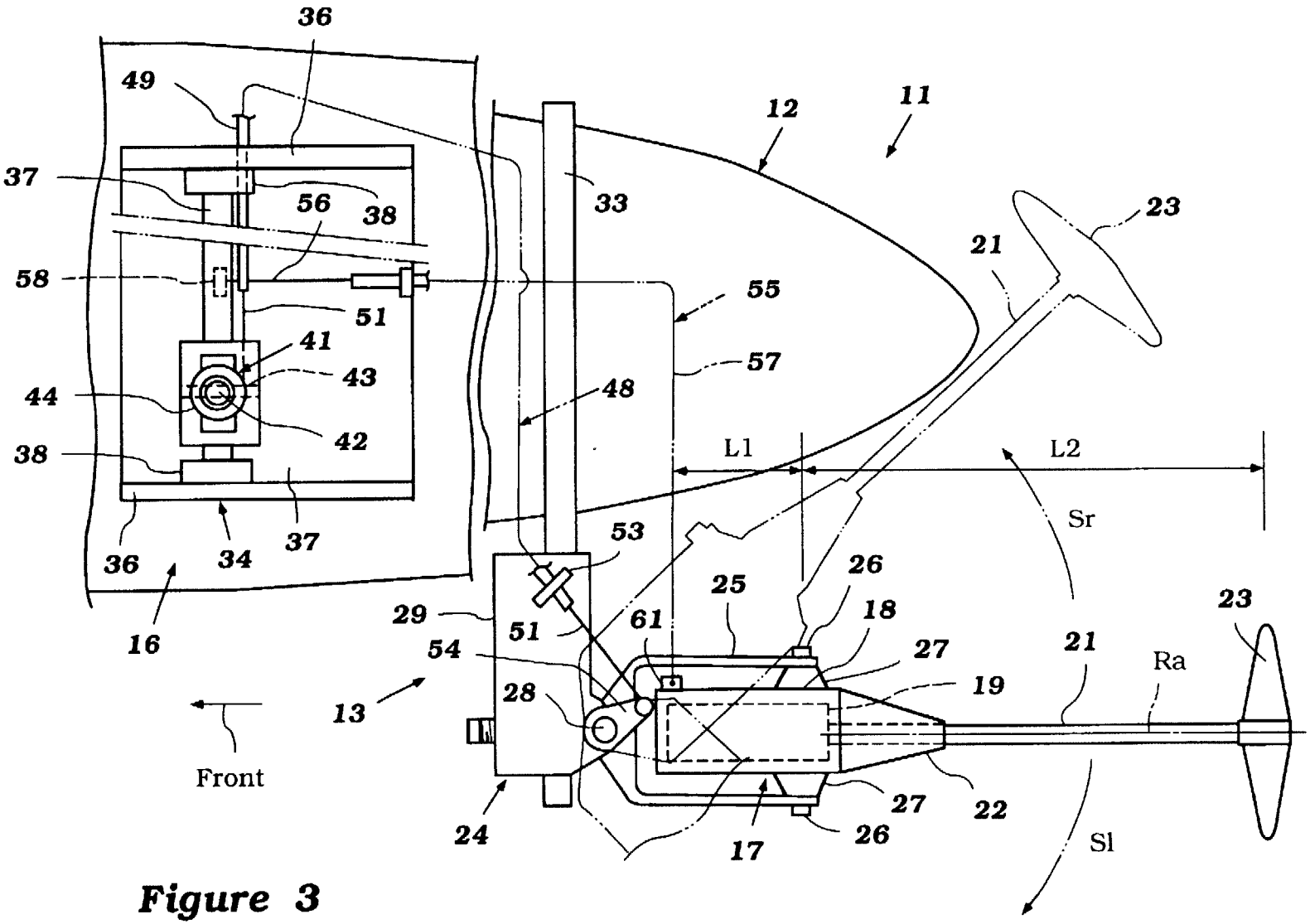
FIG. 3 is a top, plan view, in part similar to FIG. 2, and shows additional control positions and certain geometric relationships in connection with the propulsion device.

Referring now additionally to FIGS. 2 and 3, the propulsion device 13 will be described in more detail. The propulsion device 13 is comprised of a propulsion unit, indicated generally by the reference numeral 17. This propulsion unit 17 is comprised of an outer housing 18 in which a reversible variable speed electric motor, indicated by the reference numeral 19 is sealingly contained.

The electric motor 18 has an output shaft that drives a coaxially disposed propeller shaft 21. The propeller shaft 21 is rotatably journaled at its forward end within the housing 18 and which extends rearwardly beyond the trailing part 22 of the housing 18 for a reason which will be described. A propulsion device such as a propeller 23 is affixed for rotation at the rear end of the propeller shaft 21. The propeller shaft 21 rotates about a rotational axis indicated at Ra.

The propulsion device 17 as thus far described is mounted to the hull 12 by means of a mounting arrangement, indicated generally by the reference numeral 24. This mounting arrangement 24 includes a yoke member 25 that has a pair of pivot pins 26 that afford a pivotal connection to lugs 27 formed on the outer housing 18 of the propulsion unit 17. This pivotal connection defines a transverse, horizontally extending tilt axis about which the entire propulsion unit 17 may be pivoted. This pivotal movement accommodates trim adjustments as indicated by the arrows Tu and Td in FIG. 2.

The yoke 25 has a forwardly extending portion that is affixed to the lower end of a combined steering and support shaft 28. The upper portion of this steering and support shaft 28 is journaled within a supporting housing 29. This permits steering of the propulsion unit 17 about a vertically-extending axis defined by the journal of the steering shaft 28 in the housing 29. This permits steering movement in the right and left directions as indicated by the arrows Sr and Sl in FIG. 3.

The housing 28 is provided with a clamping mechanism 31 so as to permit detachable connection to an outrigger post 33 that may be affixed to span across the upper peripheral edge 34 of the watercraft hull 12. This permits adjustment of the lateral position of the propulsion unit 13 relative to the hull 12. Also, fore and aft adjustment is possible by moving the outrigger post 33 forwardly or rearwardly. Furthermore, by adjusting the vertical position of the housing 29 on the outrigger post 33 the height or depth of submersion of the propulsion unit 17 may be controlled.

Figure 4:
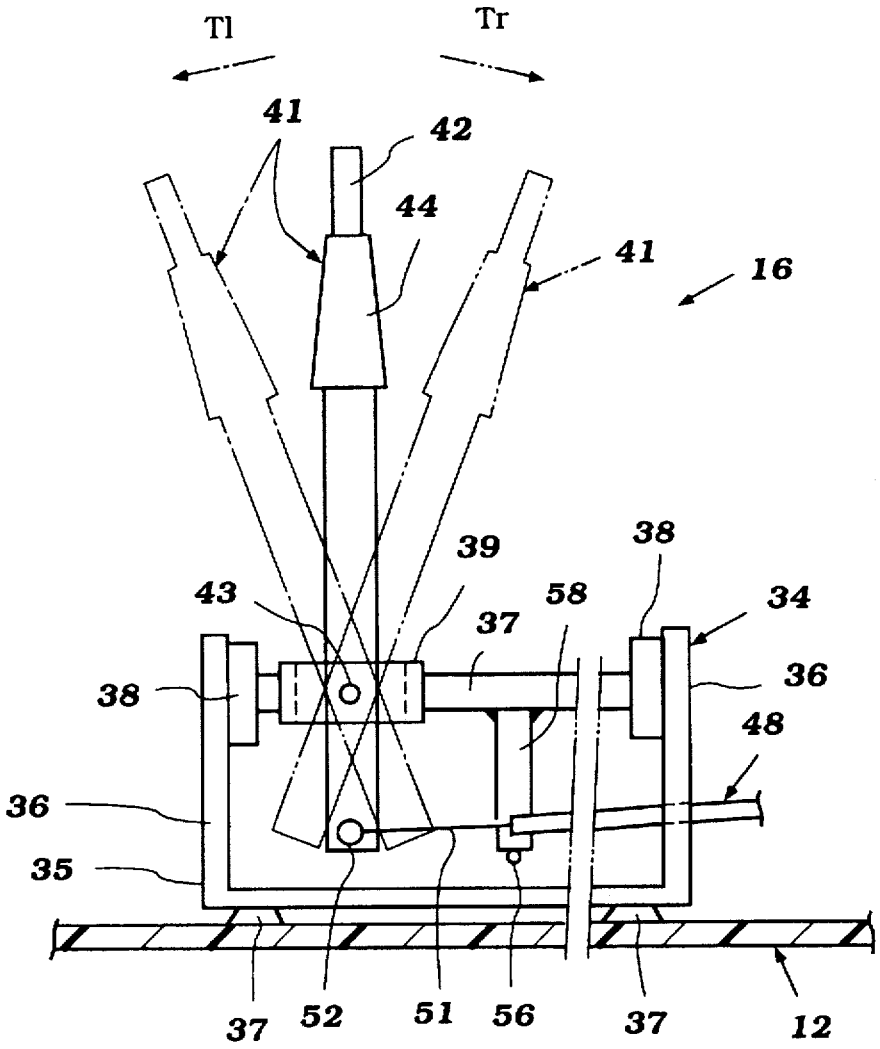
FIG. 4 is a cross sectional view taken along the line 4—4 of FIG. 2 and looking perpendicular to the views of FIGS. 2 and 3 and shows control unit in its various positions.
Figure 5:
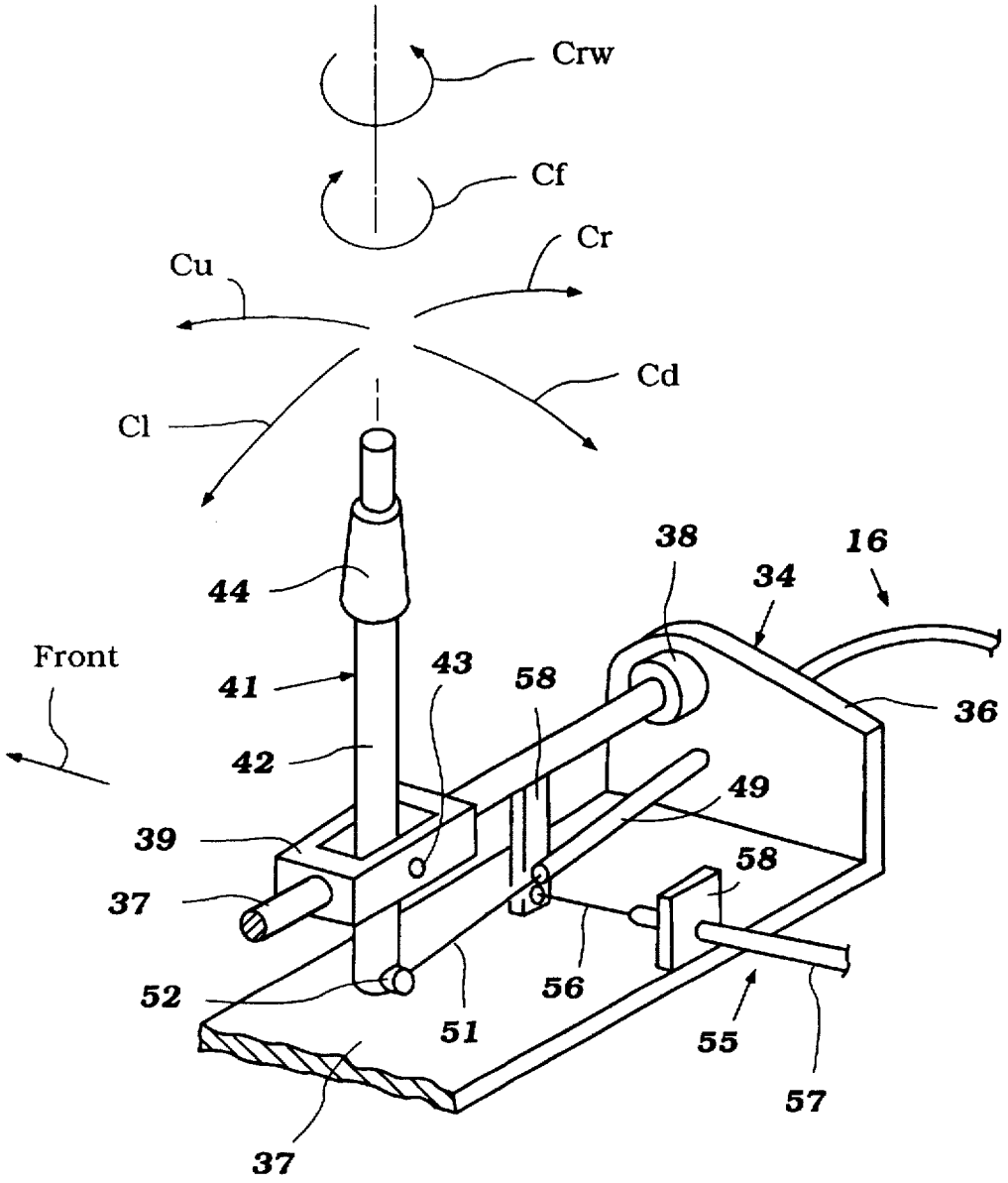
FIG. 5 is a perspective view looking from the side and rear and showing the various control movements for the control unit.

As may be seen in FIG. 2, when operating at a normal neither trimmed up or trimmed down condition, the major portion of the housing assembly 18 and the contained components are disclosed below the waterline WL. Also, in this position, the propeller shaft 21 is totally submerged and the major portion of the propeller 23 is submerged. However, as seen in FIG. 2, the trim can be adjusted and the propeller 23 can actually be lifted totally out of the water. The control device 16 will now be described by principal reference to FIGS. 1, 4, and 5, although it also appears in FIGS. 2 and 3. The connection of the control device 16 to the propulsion device 13 will then be described later by reference to all of the figures.

The control unit 16 includes a base housing assembly, indicated generally by the reference numeral 34 which is comprised generally of a lower wall portion 35 and a pair of upstanding side walls 36. The lower wall portion 35 is formed with elastic feet 37 so that it can be conveniently placed and supported along the length of the hull 12 at any desired position. If desired, this mounting may be done by permanently affixing it to the watercraft hull.

Between the legs 36, there extends a support shaft 37 which is journaled for rotation in a pair of bearings 38 provided on the inner sides of the legs 36. A yoke 39 is disposed at one side of this shaft 37 and preferably adjacent one of the side legs 36.

A control lever, indicated generally by the reference numeral 41 has a shaft-like portion 42 that extends through the yoke 39 and which is pivotally connected thereto by pivot pins 43 on its forward and reverse sides. Hence, the control lever 41 may be pivoted from side to side as indicated by the arrows Cl and Cr for effecting steering of the propulsion unit 17 in the direction Sr and Sl, respectively. The connection by which this is accomplished will, as mentioned above, be discussed later.

By rotating the lever 42, yoke 39 and shaft 37 in forward or reverse directions as indicated by the arrows Cu and Cd it is possible to trim the propeller shaft 21 and propeller 23 in the trim up Tu and trim down Td conditions. Again, the interconnection by which this is done will be described later.

Finally, the control lever 42 has adjacent its upper end a rotatable member 44 which is supported on the control shaft lever 42 for rotation about its longitudinal axis. The rotatable portion 44 encloses a rheostat 45 (see FIG. 2) for controlling the connection between a battery 46 and the terminals of the electric motor 19 through a wire conductor shown schematically at 47. This permits control of not only the amount of electrical current delivered to the motor 18 but the polarity thereof.

By rotating the control portion 44 in a clockwise direction as shown by the arrow Cf the forward speed of the electric motor 19 and propeller 23 can be controlled. By rotating in the reverse direction Crw it is possible to reverse the polarity of the voltage supplied to the motor 19 and its degree of rotational speed. Hence, the control 41 acts as a single lever control that controls not only steering speed but also trim.

In order to convert the pivotal movement of the control lever 42 about the pivot pin 43 into steering movement a first wire actuator, indicated generally by the reference numeral 48 is provided. This wire actuator 48 includes a surrounding protective sheath 49 and contained wire element 51.

One end of the wire element 51 is connected by means of a fastener 52 to the lower end of the lever 42 of the control member 41. The wire actuator 48 extends transversely outwardly beyond the hull of the watercraft and is supported by a bracket 52 that is affixed to the upper end of the support member 29. This end of the wire actuator element 51 is connected to a short steering lever 53 that is affixed to the upper end of the steering shaft 28 so as to effect the steering movement of the propulsion device 17 about the steering axis.

In order to transmit the trim adjustment of the control lever 41 to the propulsion unit 17, a further wire actuator, indicated generally by the reference numeral 55, is provided. This wire actuator 55 includes a control wire 56 that is contained within a protective sheath 57.

One end of the control wire 56 is affixed to a lever arm 58. The lever arm 58 is, in turn, welded to the shaft 37 and depends between the legs 36 of the mounting bracket 34.

The protective sheath 57 is fixed at the corresponding end to the mounting plate 34 by a support bracket 58. The wire actuator 55 extends over the side of the watercraft hull 12. The actuator 55 then depends downwardly and the sheath 57 is affixed to the yoke member 25 by means of a bracket 59. The corresponding end of the wire actuator element 56 is connected to the motor housing 18 by means of a fastener assembly 61. As a result of this connection, the trim movement can be accomplished as aforenoted.

Finally, a geometric relationship that permits a wide variety of mounting positions for the propulsion unit 13 will be described by primary reference to FIGS. 2 and 3. It should be noted that the distance between the pivot axis defined by the pivot pins 26 and the from end of the motor housing 18, defined by the dimension L1 is substantially less than the length of the unit in the opposite direction to the end of the propeller 23 indicated by the dimension L2. As a result of this, it is possible to permit a wide latitude of steering movement as shown in FIG. 3 while still maintaining the propulsion unit close to the water level and without interfering with the hull 12 as shown by the extreme right-hand steering position shown in phantom lines in FIG. 3.

Hence, the device is very compact, simple, and nevertheless can be utilized with a wide variety of small types of watercraft and watercraft having hull configurations that do not afford the normal transom mounting as with small outboard motors. Also, no special mounting brackets are required. A simple outrigger bar need be merely positioned across the top of the hull. Furthermore, the single lever control permits all functions to the outboard propulsion device to be controlled by an operator and permits latitude in where the operator may sit in the watercraft.

Of course, the foregoing description is that of preferred embodiments of the invention, and various changes and modifications may be made without departing from the spirit and scope of the invention, as defined by the appended claims.

What is claimed is:

1. An outboard motor comprising a propulsion system consisting of a prime mover and propeller shaft driven by said prime mover and contained within a common housing and driving a propulsion device supported by said common housing, and means for mounting said common housing from a watercraft hull with said common housing being mounted at least in substantial part submerged in a body of water and for providing about a generally vertically-extending axis for steering of the associated watercraft and for pivotal movement about a generally horizontally-extending axis for adjusting the trim of said propulsion device.

2. An outboard motor as set forth in claim 1, wherein the prime mover comprises an electric motor.

3. An outboard motor as set forth in claim 2, wherein the electric motor has an output shaft that is coaxial with and in driving relationship to the propulsion shaft.

4. An outboard motor as set forth in claim 3, wherein the propulsion device comprises a propeller.

5. An outboard motor as set forth in claim 1, wherein the vertically-extending steering axis is defined by a steering shaft journaled at its upper end in an attachment bracket for attachment to the watercraft hull.

6. An outboard motor as set forth in claim 5, further including a yoke fixed to the lower end of the steering shaft and pivotally supporting the common housing about the horizontally extending axis.

7. An outboard motor as set forth in claim 6, wherein the attachment bracket is adjustably connectable to the watercraft.

8. An outboard motor as set forth in claim 1, further including a control unit mountable within the hull of the watercraft and operably associated with the propulsion system for controlling the operation of the propulsion system.

9. An outboard motor as set forth in claim 8, wherein the control unit comprises a pivotally supported lever for pivotal movement about a longitudinally extending axis and for effecting steering of the propulsion device.

10. An outboard motor as set forth in claim 8, wherein the control unit comprises a pivotally supported control lever supported for pivotal movement about a transversely extending axis for controlling the trim of the propulsion device.

11. An outboard motor as set forth in claim 10, wherein the pivotally supported lever is also supported for pivotal movement about a longitudinally extending axis and for effecting steering of the propulsion device.

12. An outboard motor as set forth in claim 11, wherein the prime mover comprises a reversible electric motor and further including a rotatable member carried by the control lever for controlling the speed and direction of rotation of the electric motor.

13. An outboard motor as set forth in claim 12, wherein the vertically-extending steering axis is defined by a steering shaft journaled at its upper end in an attachment bracket for attachment to the watercraft hull.

14. An outboard motor as set forth in claim 13, further including a yoke fixed to the lower end of the steering shaft and pivotally supporting the common housing about the horizontally extending axis.

15. An outboard motor as set forth in claim 14, wherein the attachment bracket is adjustably connectable to the watercraft.

16. A control device for an outboard motor comprised of a mounting base adapted to be positioned within the hull of a watercraft, a shaft journaled for rotation within said base about a transversely extending axis, a control lever pivotally connected to said shaft about a longitudinally extending axis and means for providing a first wire actuator connection for transmitting movement of the control lever about said longitudinally extending axis to steering movement of an associated outboard motor and a second wire actuator adapted to be operatively connected to said control lever for transmitting motion of said control lever about said transversely extending axis to tilt operation of the outboard motor.

17. A control device as set forth in claim 16, further including a rotatable member carried by the control lever for controlling the speed rotation of a prime mover of the outboard motor.

18. A control device as set forth in claim 17, wherein the prime mover comprises an electric motor.

19. A control device as set forth in claim 18, wherein the electric motor is reversible and the rotatable member also controls the direction of rotation.

* * * * *